US005243775A

United States Patent [19]

Swain

[11] Patent Number: 5,243,775

[45] Date of Patent: Sep. 14, 1993

[54] SPORTS-SHOE SOLE AND A GRIPPER CONNECTED TO SUCH A SOLE

[75] Inventor: Bernhard Swain, Balingen-Ostdorf, Fed. Rep. of Germany

[73] Assignee: Sportartikelfabrik Karl Uhl GmbH, Balingen, Fed. Rep. of Germany

[21] Appl. No.: 821,585

[22] Filed: Jan. 16, 1992

[30] Foreign Application Priority Data

Feb. 11, 1991 [DE] Fed. Rep. of Germany ..... 4104071

[51] Int. Cl.[5] ..... A43B 5/00; A43C 15/16

[52] U.S. Cl. ..... 36/134; 36/127; 36/670

[58] Field of Search ..... 36/127, 134, 128, 67 R, 36/67 D, 66, 61, 62, 65, 67 A

[56] References Cited

U.S. PATENT DOCUMENTS

| | | | |
|---|---|---|---|
| 1,768,426 | 6/1930 | Stelzer | 36/67 D |
| 2,258,734 | 10/1941 | Brady | 36/134 |
| 3,553,858 | 1/1971 | Austin | 36/127 |
| 4,299,038 | 11/1981 | Epple | 36/670 |
| 4,318,232 | 3/1982 | Ching | 36/670 |
| 4,445,289 | 5/1984 | Beneteau | 36/134 |
| 4,633,600 | 1/1987 | Dassler et al. | 36/134 |
| 4,648,187 | 3/1987 | Dassler et al. | 36/134 |
| 5,036,606 | 8/1991 | Erich et al. | 36/134 |
| 5,065,534 | 11/1991 | Collins | 36/134 |

FOREIGN PATENT DOCUMENTS

| | | | |
|---|---|---|---|
| 2542116 | 3/1977 | Fed. Rep. of Germany | 36/67 D |
| 3423363 | 1/1986 | Fed. Rep. of Germany | 36/67 D |
| 1005909 | 4/1952 | France | 36/67 D |

*Primary Examiner*—Steven N. Meyers

*Attorney, Agent, or Firm*—Shlesinger, Arkwright & Garvey

[57] ABSTRACT

The invention concerns a sports-shoe sole with metal bushes open toward the sole tread and comprising, at their inside walls, fastening elements (for instance inside threads) to mount grippers such as studs, spikes, golf cleats etc., each metal bush being concentrically enclosed at a radial distance from plastic fastening elements.

A sports-shoe sole designed in such manner not only is suitable for all gripper types known heretofore but furthermore also for very special, novel grippers for which the fastening members are in the form of a plastic sleeve comprising fastening elements (for instance an outside thread) at their outer wall and which correspond to the sole-side plastic fastening elements (for instance an inside thread), the inside diameter of the plastic sleeve being at least as large as the outside diameter of the sole-side metal bush, in such manner that for the assembled state of the gripper, the plastic sleeve can be fitted over the sole-side metal bush.

19 Claims, 2 Drawing Sheets

SPORTS-SHOE SOLE AND A GRIPPER CONNECTED TO SUCH A SOLE

FIELD AND BACKGROUND OF THE INVENTION

The invention concerns a sports-shoe sole with metal bushes open toward the sole tread surface and comprising fastening elements at its inner wall to mount grippers such as studs, spikes, golf cleats etc.

Sports-shoe soles of the above kind fitted with threaded steel or aluminum insets have long been widely known. The associated grippers such as studs or spikes comprise threaded steel pins. If the shoes are golf shoes, the threaded metal insets comprise inside threads of 0.283 2' and the associated cleats matching outer threads. As regards other sports shoes, size M5 inner or outer threads are typical. The advantages of this known fastening system consist, on one hand, of world-wide acceptance (they represent virtually the professional standard) and, on the other hand, of the simple and low manufacturing costs of soles with inserted or subsequently forced-in threaded insets.

However the state of the art also entails substantial drawbacks. Illustratively steel insets, even though plated as a rule, tend to rust, and aluminum threads are susceptible to damage. While the threaded pins of the studs/spikes cooperating with the threaded insets in the sole are also plated, they will also rust if damaged even slightly, and then may be stuck due this rusting in the threaded insets.

Especially as regards the sportsmen, it is also drawback that the known connection system is fairly heavy on account of the metal parts being used. This comparatively high weight of the known connection system also arises in that the threaded metal insets can only be installed in solid plastics with relatively high rigidity in order to be reliably anchored in the sole. If on the other hand such threaded metal insets are anchored in rubber or plastic foam soles, their anchoring area must be made appropriately large and their edges must be rounded to prevent notching and cutting. As a result the threaded insets will be big, heavy and expensive.

If the grippers proper are made conventionally from a lightweight material, for instance from plastic, rubber, leather or aluminum, then the gripper will be in two parts because the threaded pin cooperating with the threaded inset in the sole as a rule is required to consist of steel (anchoring requirement), but this dual-part feature represents costly manufacture. (Threaded pins made of aluminum are the exception).

Another inadequacy feature of the known connection system is that moisture can pass through the threads into the shoe.

Moreover it is known to affix plastic insert parts in plastic shoe soles, said insert parts evincing an inner thread width of 10 mm. The associated grippers such as soccer studs or golf spikes comprise plastic bases with a matching outer thread. Because of the absence of metal parts, the known connection system is characterized by low weight. Nor are there any rust-susceptible parts, and there is no danger of the grippers freezing into place in the sole by rusting. Again the grippers can be manufactured in simple manner as integral injection-molded parts.

Nevertheless this known connection system also incurs various drawbacks and insufficiencies. The threads of the sole insets on one hand and on the other hand the gripper pins are fairly easily damaged by foreign bodies (pebbles, soil), especially when changing the grippers. The comparative softness of the plastic easily allows undesired loosening of the thread connection. While special measures are taken in some embodiments to prevent such loosening (for instance serrations), such measures perforce entail higher complexity and costs in manufacture. Replacing damaged or worn grippers frequently is possible only with difficulty because the connecting system being discussed deviates from the professional standard.

OBJECTS AND SUMMARY OF THE INVENTION

Based on the above state of the art, the object of the invention is a connecting system of the initially cited kind which shall be designed on the side of the sole, i.e. sole-side, in such a way that the above drawbacks are averted, permitting moreover using not only all known grippers (see above) but also specially newly developed ones (see below).

This problem is solved for a sports-shoe sole of the initially cited species in that each metal bush in the sole is concentrically enclosed by, and a radial distance away from, a further inner wall with plastic fastener elements.

Preferably the fastener elements of the metal bushes and the plastic fastener elements enclosing said bushes shall be inner threads, though they also may be designed in an arbitrary different manner as a compatible plug-in or snap-in system to detachably connect the sole to the grippers in frictional or form-locking manner.

A substantial advantage of the plastic connection parts of the invention that are present on the side of the sole is their problem-free shaping, their reliable anchoring in those soles which also are less dense or rigid, for instance rubber or foam material.

Compatible grippers with plastic bases are applicable in the invention (see further below), but moreover, while using the conventional inner metal fastener, so are also the known standard grippers with threaded metal pins. Thereby comprehensive and world-wide spare parts are available for the pertinent sports shoes with grippers.

The especial advantage of the sole of the invention is that, as already stated, it is suited for very specific grippers which while similar to the known ones (see above), consist of a gripper body and fastening elements integrated into the sole side, but on the other hand are characteristic in the light of the invention by the fastening elements being in the presence of a plastic sleeve comprising fastener elements at its outside that match the sole-side plastic fastener elements, whereby the inside diameter of the plastic sleeve is at least as large as the outside diameter of the sole-side metal bush, in such a way that when the gripper has been assembled, the plastic sleeve fits over the sole-side metal bush.

The special grippers of the invention can be made integrally and therefore very simply by injection-molding and accordingly they are better designed and more economical than the industrial-standard grippers. Using the grippers of the invention, the metal bush together with its inside thread shall be imbedded in the plastic sleeve of the gripper, whereby advantageously moisture shall be prevented from entering the shoe inside and hence also the rusting of the threaded metal bush. At the same time the above described disadvantageous welding of the threads resulting from rusting is eliminated.

Being entirely made of plastic, the grippers of the invention are much lighter than conventional grippers with steel threaded pins.

Regarding the further design of the sole-side connection parts, the invention proposes mounting the metal sleeve by its rearward end, which is away from the sole tread surface, into the plastic forming the enclosing fastener elements. Thereby the metal sleeve is held in place in problem-free manner.

The plastic fastener elements, or a connecting element made of plastic, may be an integral part of the sole, either the entire sole consisting of the same plastic, or the connecting element being undetachably imbedded into the sole when this sole is being manufactured.

Alternatively, moreover, the connecting element containing the plastic fastener elements can be manufactured jointly with the metal bush as a separate inset and can be affixed in a sole clearance provided for that purpose.

The width and the shape of the plastic fastener elements of the invention in the sole, preferably of the plastic inside thread, can be selected in such a way that the special grippers of the invention comprising a corresponding plastic outer thread also can be affixed to known soles with plastic inside threads.

The fastener elements, preferably the inside thread of the metal sleeve of the invention must be designed in such manner that conventional grippers (with threaded metal pins) can be integrated according to the professional standards.

The plastic inner thread and accordingly also the plastic outer thread of the special grippers concentrically enclosing the metal sleeve in the sole however also may be basically designed to be free. Illustratively an especially large pitch may be selected in order to effortlessly screw in the gripper of the invention. Again, in lieu of a thread, different fastening elements may be used, for instance a plug-in or a snap-in system.

Another advantage of the sole-side fastening system of the invention compared with conventional fastening systems is that it may remain operational even after any damage to the plastic inside thread, rather it then remains suitable for the use of conventional grippers with threaded metal pins. These latter then can still be screwed into the intact metal bushes.

In an especially advantageous embodiment of the invention, several connecting elements containing the plastic fastening elements together with the particular associated bushes are combined into sets by ledges of material and may be imbedded in the sole. In a further development of this concept, it is moreover possible to combine all the connecting elements containing the plastic fastening elements of a sole, together with the particular associated metal bushes, by ledges of material, into a skeleton which may be imbedded in the sole. Thereby the positioning of the connecting elements in the sole can be simplified in manufacture because the connecting elements already are properly arrayed relative to each other beforehand.

In an advantageous development of the invention, especially simple manufacture of the sole-side connecting elements can be achieved in that the connecting elements containing plastic fastening elements, or the set, or the skeleton, shall be formed by injection molding.

Further embodiment modes and advantages are stated in the claims.

The special gripper of the invention is so designed in a special embodiment mode that a centering pin is mounted to its sole-side end face and is concentrically surrounded by, and radially spaced from, the plastic sleeve, the diameter of said pin being selected in such manner that for the assembled state of the gripper, it will enter the threaded bore of the metal bush in snug-fit manner. The centering pin may be cylindrical, though preferably it shall be slightly conical so as to taper toward the free end, i.e. the side of the sole, the maximum pin diameter being larger than the inside diameter of the threaded bore of the metal bush. The slightly conical shape of the centering pin causes spreading of the plastic sleeve when the gripper is screwed into the sole-side connection part. The (desired) consequence in turn is some stickiness of the thread at the last thread turns, somewhat like a forcefit, whereby unintended loosening of the gripper is made more difficult or prevented.

In addition or alternatively, the inside wall of the plastic sleeve may be made slightly conical, i.e. diverging toward the free (sole-side) end, in such manner that at the (rear) end of the plastic sleeve away from the sole, the width is somewhat less than the outside diameter of the metal bush. This design feature also serves to bring about or reinforce the desired firmness of the thread connection between the gripper and the sole. This is so because in the rigidly mounted state of the gripper with exploitation of the material elasticity of the plastic sleeve, this plastic sleeve rests in force-fit manner on the metal bush of the sole-side connection part.

The drawing shows the illustrative embodiments of the invention, which are elucidated below.

DETAILED DESCRIPTION OF THE INVENTION

Figure 1:
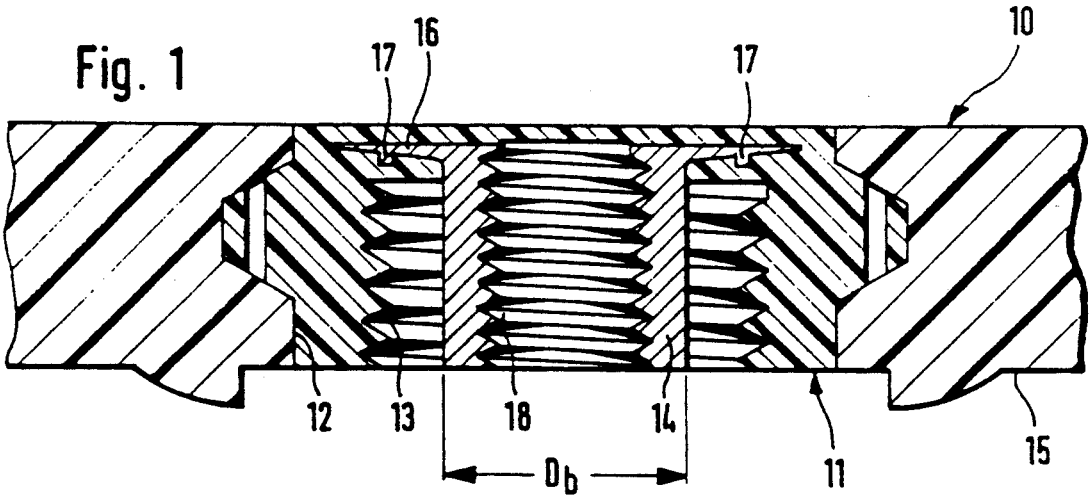
FIG. 1 is a partial and schematic vertical section of a sports shoe sole with a sole-side connection part to screw in a gripper.

As shown in FIG. 1, 10 denotes a sports-shoe sole made of a suitable material, for instance plastic. A connection part 11, also made of a plastic, for instance a thermoplastic, and preferably manufactured by injection molding, is imbedded in the sole 10. The connection part 11 is cross-sectionally circular or similar and, if an integral component of the sole 10, it can be manufactured jointly with said sole or else it may be inserted or pressed into a clearance 12 in the sole provided for that purpose.

At its inside wall, the connection part 11 comprises fastening elements 13 which in the embodiment shown are the inside thread. Appropriately this is a 10 mm wide thread, whereby the compatible grippers also will fit known soles with corresponding connection elements.

Basically however the fastening elements 13 also may be of other designs, for instance in the form of plug-in or snap-in systems.

A metal bush 14 for instance of steel, aluminum or another suitable alloy, is inside the connection part 11 in irrotational and axially immovable manner and is enclosed concentrically by the plastic inside thread 13. For these purposes the metal bush 14 is provided at its rear end away from the sole tread 15 with a flat spreading rim 16 whereby it is anchored into the plastic of the connection part 11, preferably this connection part 11 being injection-molded around it. The axial extensions 17 integrally formed into the rim 16 of the metal bush 14 or subsequently affixed to it ensure irrotationality.

An inside thread or mounting element 18 is milled into the inside wall of the metal bush 14 and preferably its dimensions are M5×0.8 or 0.23830 UNS-2$\beta$. The metal bush 14 accordingly is able to receive conventional threaded grippers such as studs, golf cleats and the like (not shown) that evince a screw-in pin with corresponding outer thread.

Alternatively however the metal bush 14 instead of comprising the inside thread 18 can be fitted with any other fastening elements, for instance a snap-in or plug-in system.

Figure 2:
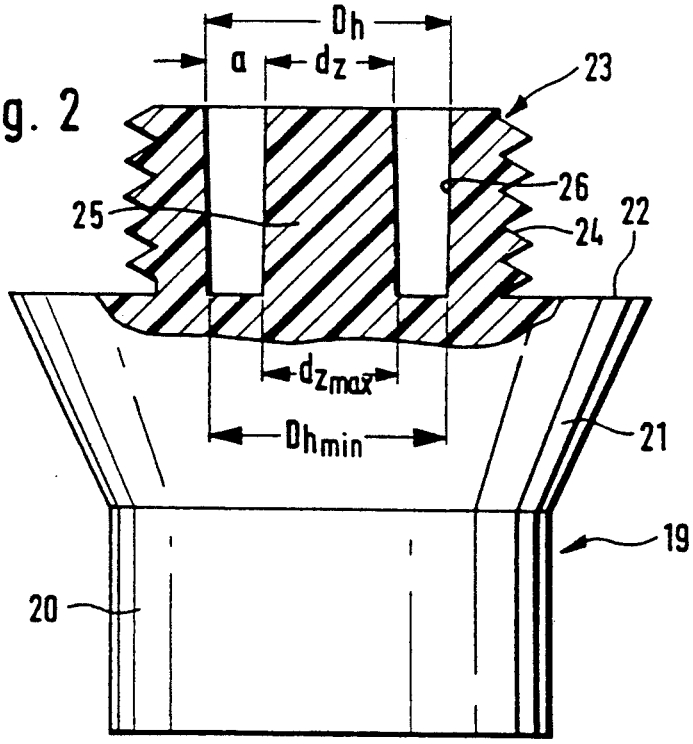
FIG. 2 is a schematic and partial elevation (corresponding to FIG. 1) of a gripper which shall be screwed into the sole of FIG. 1.
Figure 3:
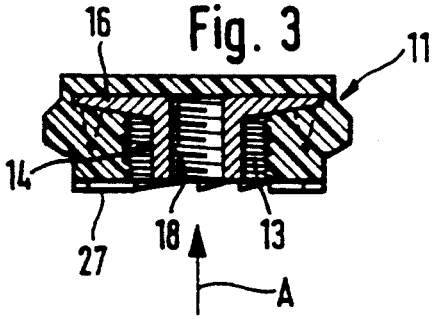
FIG. 3 is a vertical section corresponding to FIG. 1 (section III—III in FIG. 4) of a practical embodiment of a connection part to be integrated into the sports shoe sole or be retrofitted into it as an inset, said connection part being used in conjunction with a gripper.
Figure 4:
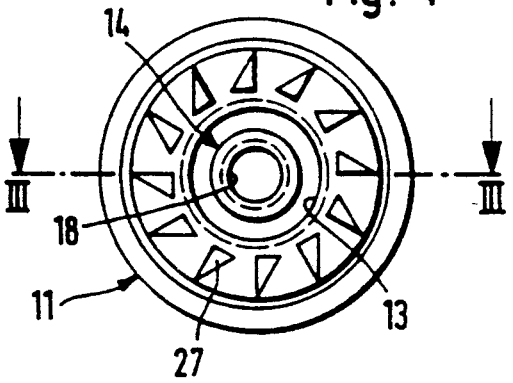
FIG. 4 is a plan view of the connection part of FIG. 3 as seen from below (arrow direction A in FIG. 3)
Figure 5:
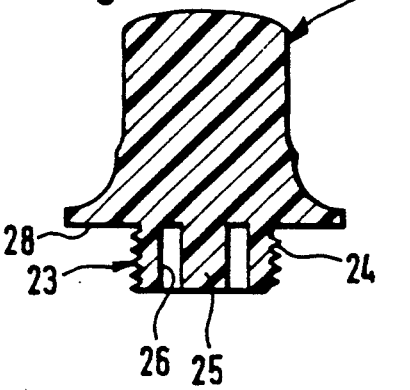
FIG. 5 is a vertical section (section V—V of FIG. 6) of a practical embodiment of a gripper for a sole-side connection part of FIGS. 3 and 4 (or FIG. 1)
Figure 6:
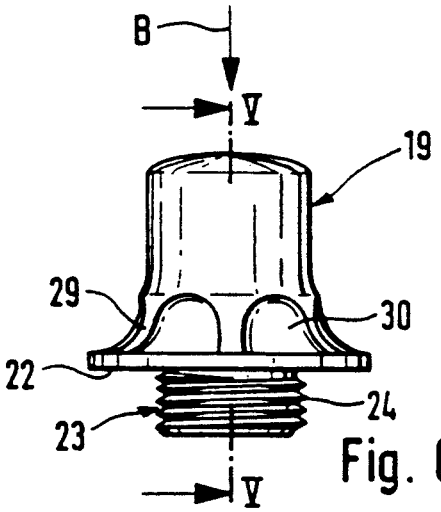
FIG. 6 is a sideview of the object of FIG. 5.
Figure 7:
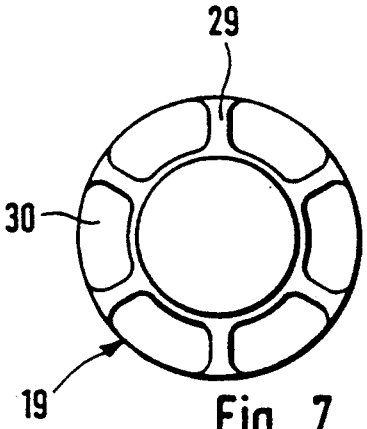
FIG. 7 is a topview (arrow direction B) of the object of FIGS. 5 and 6.
Figure 8:
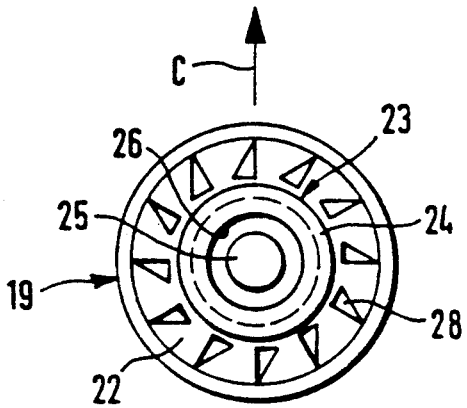
FIG. 8 is the gripper of FIGS. 5–7 in plan view seen from below (arrow direction C).

FIG. 2 shows a gripper developed specifically for the above described connection part 11 shown in FIG. 1. All the gripper is made of plastic and was integrally made by injection molding. A gripper body 19 illustratively comprises shape conventional in studs of soccer shoes. Gripper body 19 is composed of a cylindrical part 20 and a conically flaring part 21 adjoining it at the side of the sole and forming a sole-side end face 22. A plastic sleeve 23 is integrated into the end face 22 and comprises an outside thread 24 or gripper fastening element. A centering pin 25 is mounted inside the plastic sleeve 23 and is radially spaced therefrom by a distance "a"; pin 25 also is made of plastic and is integrated into the gripper body 19.

The outer thread 24 of the plastic sleeve 23 cooperates with the inside thread 13 of the sole-side connection part 11 and therefore comprises a corresponding thread for instance 10 mm wide. The inside diameter $D_h$ of the plastic sleeve 23 must be at least as large as the outside diameter $D_b$ of the metal sleeve 14 in the sole-side connection part 11 (FIG. 1). This is so because for the assembled state of the gripper 19, the plastic sleeve 23 must be able to pass over the sole-side metal bush 14.

The diameter $d_z$ of the centering pin 25 is selected in such a way that in the assembled state of the gripper 19, the centering pin 25 enters snug-fit the threaded bore 18 of the metal bush 14. For that purpose the centering pin in principle may be precisely cylindrical. Appropriately however it shall be slightly conical and be tapering toward the free (sole-side) end, the maximum diameter $d_{zmax}$ of the centering pin 25 being larger than the inside diameter of the threaded bore 18 of the metal bush 14. As a result, when the plastic sleeve 23 is screwed into the inner thread 13 of the connection part 11, the metal bush 14 shall be slightly spread apart and thereby the thread connection (i.e., thread 13/thread 24) shall be firmer. This advantageous effect also can be achieved or be reinforced in that an inner wall 26 of the plastic sleeve 23 shall be slightly conical, while the least inside diameter $D_{h\,min}$ shall be located at the (rear) end of the plastic sleeve 23 which is away from the sole and shall be slightly less than the outside diameter $D_b$ of the metal bush 14. Because of material elasticity in the plastic sleeve 23, the sleeve shall be slightly spread apart when the gripper 19 is screwed into connection part 11, and as a result a corresponding tightness in screw connection takes place. (Guide slopes, if required, may be provided at the two associated end faces of the plastic sleeve 23 on one hand and on the other hand of the metal bush 14).

FIGS. 3–8 show an embodiment already meeting the requirements of practice of a sole-side connection part (FIGS. 3, 4) and of a gripper provided for that purpose (FIGS. 5–8). For the sake of clarity, the pertinent references are the same for the same components as in FIGS. 1 and 2. However a peculiarity of the embodiment of FIGS. 3 and 4 or of FIGS. 5–8 is that stellate insertion guide slopes 27 and 28 are present at the mutually corresponding end faces of the connection part 11 on one hand and of the gripper 19 on the other hand, such slopes securing irrotationality against undesired loosening of the gripper. Moreover the gripper of FIGS. 5–8 comprises radially arranged ledges 29 with recesses 30 between them, the ledges serving as operational surfaces for an applied suitable screwdriver or the like.

I claim:

1. A sole for sport shoes, with metal bushes open toward the sole tread and comprising mounting elements at their inside walls to mount a gripper, each metal bush in the sole being concentrically enclosed by, and a radial distance from, a further inside wall comprising sole fastening elements, a gripper is mounted on each said mounting element, each said gripper including a gripper body and gripper fastening elements disposed on said gripper body on a side of said gripper body near said sole, said gripper body includes a plastic sleeve having said gripper fastening elements disposed on the outside of said plastic sleeve, said gripper fastening elements being configured for mating with said sole fastening elements of said sole; said plastic sleeve having an inside diameter at least as large as an outside diameter of each metal bush; wherein, said plastic sleeve fits over said metal bush.

2. A sole as defined in claim 1, wherein said metal bush is mounted, at its rear end away from the sole tread, in said plastic fastening elements.

3. A sole as defined in claim 1, wherein one of said plastic fastening elements and a plastic connection part containing said elements is an integral component of the sole.

4. A sole as defined in claim 1, wherein said plastic fastening elements together with each metal bush are affixed as a separate insert in a sole clearance provided for that purpose.

5. A sole as defined in claim 1, wherein several connection parts containing said plastic fastening elements are combined together with the particular associated bushes by connecting ledges of material defining sets imbedded in the sole.

6. A sole as defined in claim 1, wherein each metal bush includes a substantially flat, widened rim at its rear face away from the sole tread, where the plastic forming the plastic elements encloses each rim.

7. A sole as defined in claim 6, wherein axial extensions are integrated into said flat, widened rim.

8. A sole as defined in claim 1, wherein said plastic fastening elements include screw threads.

9. A sole as defined in claim 1, wherein the mounting elements at the inside wall of each metal bush include a screw thread.

10. A sole as defined in claim 1, wherein said sole fastening elements of said plastic sleeve include external threads.

11. A sole as defined in claim 1, wherein a centering pin is disposed on the sole-side of said gripper body and is concentrically enclosed by and at a radial distance from said plastic sleeve, a diameter of said centering pin being configured for snugly mating with the mounting elements at the inside walls of the metal bushes.

12. A sole as defined in claim 11, wherein said centering pin is cylindrical.

13. A sole as defined in claim 11, wherein said centering pin is slightly conical and tapers toward the sole-side of the gripper body, a maximum diameter of said centering pin being larger than an inside diameter defined by said mounting elements at the inside walls of the metal bushes.

14. A sole as defined in claim 11, wherein said gripper body is integral with one of said plastic sleeve and said centering pin.

15. A sole as defined in claim 1, wherein said plastic sleeve includes an inner wall, said inner wall is slightly conical and diverges outwardly toward the sole-side, a width of said plastic sleeve at an end of said plastic sleeve spaced apart from the sole-side being less than an outside diameter of the metal bushes.

16. A gripper for connection to a sole of a sports shoe, said gripper comprising:

a) a gripper body including a part for engaging the ground;

b) means disposed on said gripper body for fastening said gripper body to a sole of a sports shoe;

c) said fastening means being disposed spaced from said part for engaging the ground;

d) said fastening means includes a plastic sleeve, e) said plastic sleeve includes an inner wall having an inside diameter;

f) said plastic sleeve includes an outer wall;

g) a plurality of external threads is disposed on said outer wall; and, h) a centering pin is disposed on said gripper body and is spaced from said inner wall of said plastic sleeve.

17. A gripper in combination with a metal bush having inner threads, comprising:

a) a gripper body including a part for engaging the ground;

b) means disposed on said gripper body for fastening said gripper body to a sole of a sport shoe;

c) said fastening means being disposed spaced from said part for engaging the ground;

d) said fastening means including a plastic sleeve;

e) said plastic sleeve including an inner wall having an inside diameter;

f) said plastic sleeve including an outer wall;

g) a plurality of external threads disposed on said outer wall;

h) said plastic sleeve being configured for fitting over said metal bush when said gripper is connected thereto;

i) a centering pin disposed on said gripper body and spaced from said inner wall of said plastic sleeve; and, j) said centering pin being configured for snugly fitting into an opening defined by said metal bush when said gripper is connected thereto.

18. A gripper in combination with a metal bush as defined in claim 17, wherein:

a) said metal bush includes a substantially flat, widened rim.

19. A gripper in combination with a metal bush as defined in claim 18, wherein:

a) axial extensions are disposed on said flat, widened rim.

* * * * *